US006021614A

United States Patent [19]

Krieger

[11] Patent Number: 6,021,614

[45] Date of Patent: Feb. 8, 2000

[54] PROTECTIVE POLE CAPS FOR UTILITY POLES

[76] Inventor: Hartmut Krieger, 9739 Princess Drive, Surrey, British Columbia, Canada, V3V 2T5

[21] Appl. No.: 09/129,767

[22] Filed: Aug. 6, 1998

[51] Int. Cl.[7] ..... E04H 12/00

[52] U.S. Cl. ..... 52/301

[58] Field of Search ..... 52/300, 301, 40; 248/49, 65; 174/45 R, 158 R

[56] References Cited

U.S. PATENT DOCUMENTS 1,444,834 2/1923 Hindmarsh ..... 52/301
2,450,345 9/1948 Kervin ..... 52/301
3,250,050 5/1966 Finger et al. ..... 52/301
5,299,883 4/1994 Arth, Jr. ..... 52/301

*Primary Examiner*—Michael Safavi

[57] ABSTRACT

A protective pole cap for installation onto the top of a utility pole has a downwardly-open, cup-shaped body formed with radially inwardly and upwardly projecting, resiliently deflectable finger-shaped projections for releasible gripping engagement with the top end portion of a pole. An external projection on the cap forms an eye for engagement by a installation pole, thus allowing one-man installation, even onto an in-service pole without disconnecting power, and without any mechanical fasteners.

6 Claims, 3 Drawing Sheets

PROTECTIVE POLE CAPS FOR UTILITY POLES

BACKGROUND OF THE INVENTION

1. Field of the Invention

The present invention relates to protective pole caps for installation onto the top end portions of poles.

2. Description of the Related Art

When the tops of wooden poles are exposed to the atmosphere, they are subjected to weathering and decay, particularly since cheaper and more readily available but more decay-prone woods such as pine are being employed in recent years for utility poles, instead of the cedar woods which were previously used, and, also, to damage by animals, for example by birds. It has therefore previously been proposed to provide a protective pole cap which can be fitted over the top of a wooden pole to protect the pole top against such harmful effects.

However, these previously proposed protective pole caps have had the disadvantage that they require a person fitting such a pole cap to be positioned in the close vicinity of the top of a pole for installing the pole cap onto the pole top and, then, for securing the pole cap, e.g. by nails, to the top of the pole. Consequently, the installation of these previously-proposed pole caps is time-consuming and labour-intensive, particularly since a second person is usually required to operate a cherry-picker or bucket truck carrying the person installing the caps, and furthermore the person installing and securing the pole caps may, in many cases, be exposed to the risk of electrocution or to other danger.

BRIEF SUMMARY OF THE INVENTION

It is accordingly an object of the present invention to provide a novel and improved pole cap which can be installed onto and secured to the top of a pole by a person from a location spaced from the pole top.

According to the present invention, there is provided a protective pole cap which comprises a downwardly-open, cup-shaped body for installation onto a top end portion of a pole. The cup-shaped body has an inner surface and projections extending inwardly from the inner surface. The projections are resilient to allow deflection of the projections into gripping engagement with the top end portion of the pole.

The protective pole cap according to the present invention can be installed onto the top of a pole simply by lowering the cap onto the top of the pole. The projections are thereby resiliently deflected by the top of the pole and then, by gripping engagement with the pole, serve to retain the cap on the top of the pole.

To facilitate the installation of the present pole cap onto the pole, the cup-shaped body preferably includes an external projection which forms an eye for engagement of an installation tool, e.g. a rod of the type commonly known as a "shotgun" or a "hot stick" and used for the installation of equipment onto live lines. The person installing the cap, standing in and controlling a bucket truck, can then use this installation tool to install the cap on its pole while he remains at a safe distance from the pole and any live wires supported by the pole.

To provide an air gap between the top of the pole and the cup-shaped body, the latter is preferably formed with an upwardly convergent frusto-conical top which, on installation of the cap, engages the top of the pole.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENTS

Figure 1:
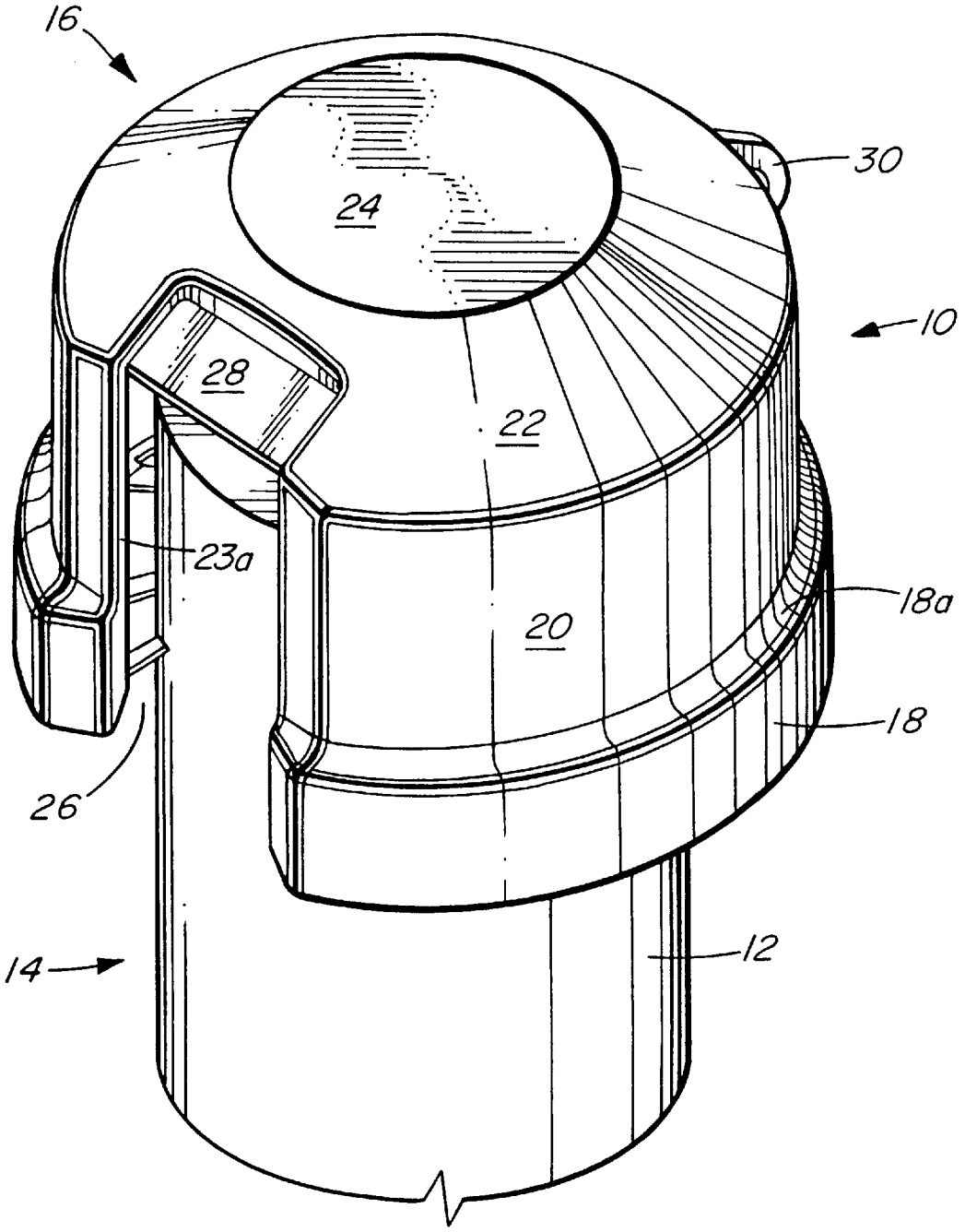
FIG. 1 shows a view in perspective of a protective pole cap according to the present invention installed on a top end portion of a utility pole.
Figure 2:
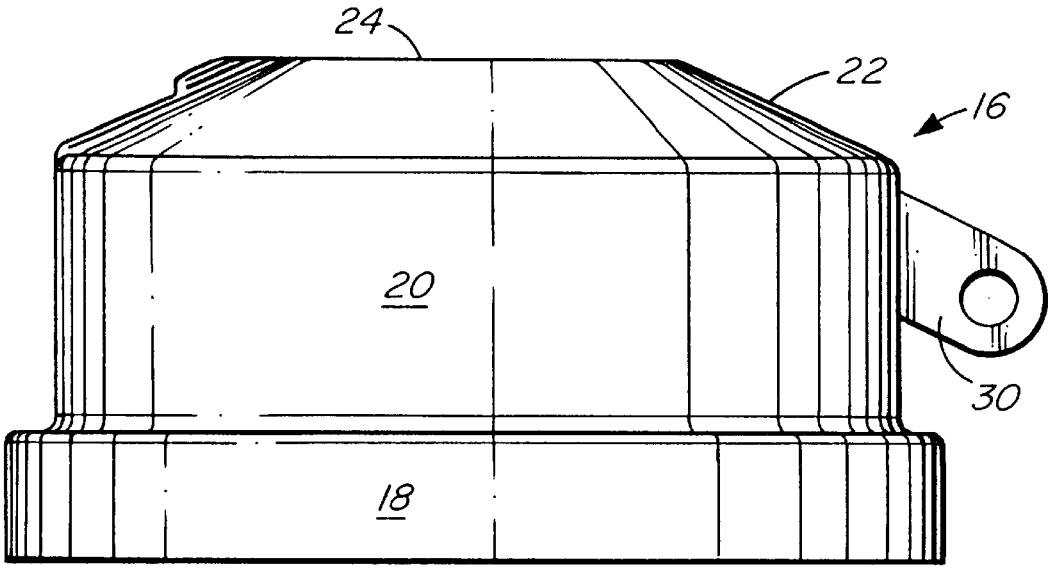
FIG. 2 shows a view in side elevation of the cap of FIG. 1.

In FIG. 1 of the accompanying drawings, there is shown a protective pole cap, indicated generally by reference numeral 10, in the form of a molding of plastic material, which is installed on a top end portion 12 of a utility pole indicated generally by reference numeral 14.

The cap 10 has a downwardly-open, generally cup-shaped body, indicated generally by reference numeral 16, comprising a lower skirt portion 18, an intermediate cylindrical wall 20, an upwardly convergent, frusto-conical top portion 22 and a flat circular top 24.

The skirt portion 18, the intermediate cylindrical wall 20 and the frusto-conical top portion 22 are interrupted, at one side of the protective pole cap 10, by recess 23 which is initially closed by a flat recessed tear-out panel 25 connected to opposite side walls 23*a* and 23*b* of the recess 23, the side walls 23*a* and 23*b* extending inwardly of the cup-shaped body 10 from the skirt portion 18 and the cylindrical wall 20 to the tear-out panel 25. To facilitate the illustration of the cap 10, the panel 25 has been omitted form the cap-shaped body 16 in FIG. 1 but has been shown in place in FIGS. 3 and 4. The panel 25 is removable to form a slot-shaped opening 26. The purpose of this opening 26 is to allow the cap 10 to be installed on a pole top provided with a "sky pin" (not shown). Sky pins are commonly installed on utility poles to support live center wires extending across and above the tops of the poles, and normally comprise a vertically elongate metal bracket bolted to one side of a top portion of a pole and extending upwardly beyond the pole top to an insulator to which a live center wire is secured. This live center wire may present a hazzard to persons in the vicinity of the pole top. By orienting the cap 10 so that the sky pin extends upwardly through the opening, the cap 10 is not obstructed by the sky pin.

The skirt portion 18 includes a radially extending portion 18*a* which connects the skirt portion 18 to the cylindrical wall 20 and which serves to reinforce the cup-shaped body 16 against distortion after removal of the panel 25. If necessary, further reinforcement, e.g. in the form of a metal insert (not shown), may be provided for that purpose.

Also, an upper portion of this opening 26, where the opening 26 extends into the frusto-conical top portion 22, is closed by a further-tear-out panel in the form of a flange 28 which is recessed into the frusto-conical top portion 22. This flange 28, which can be separated from the frusto-conical top portion 22 along opposite sides of the flange 28, can be bent upwardly by the sky pin if the cap 10 is fitted onto a pole having a somewhat small diameter.

To facilitate the removal of the panel 25, a line of weakening (not shown), e.g. perforations, may be formed around the panel 25. Likewise, the flange 28 may be connected to the frusto-conical top portion 22, at opposite sides of the flange 28, by lines of weakening to allow the flange 28 to be bent upwardly, as mentioned above, when required.

At the side of the cap 10 opposite from the recess 23 and the panel 25, the cup-shaped body 16, and more particularly the intermediate cylindrical wall 20, is formed with a single external projection 30 which, forms an eye for engagement by a so-called "shotgun" installation rod (not shown).

Figure 3:
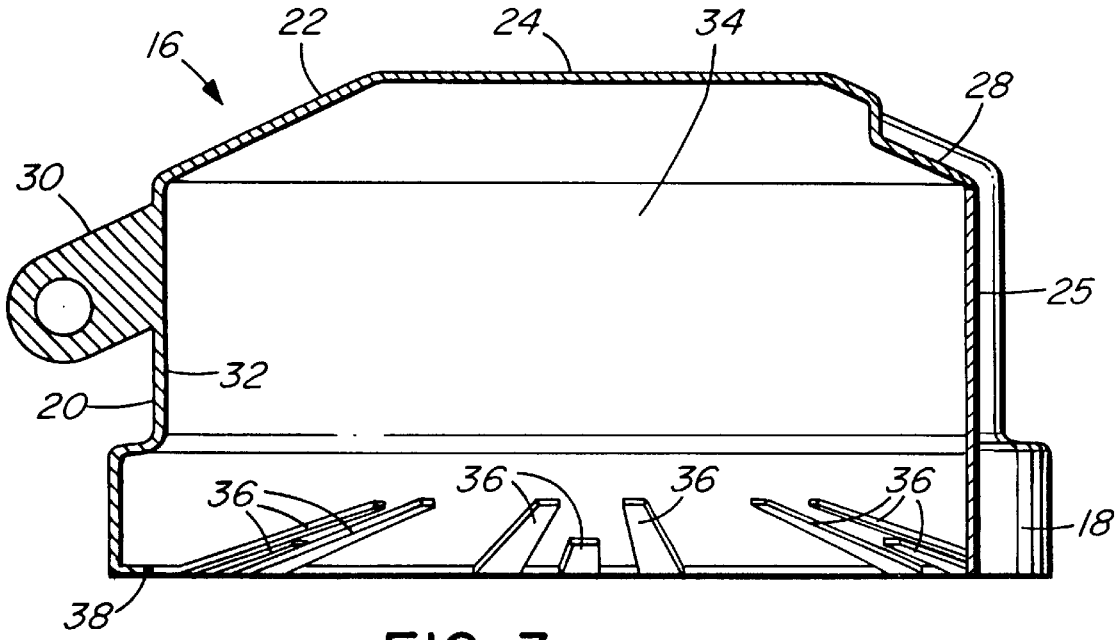
FIG. 3 shows a view in vertical cross-section through the cap of FIGS. 1 and 2.
Figure 4:
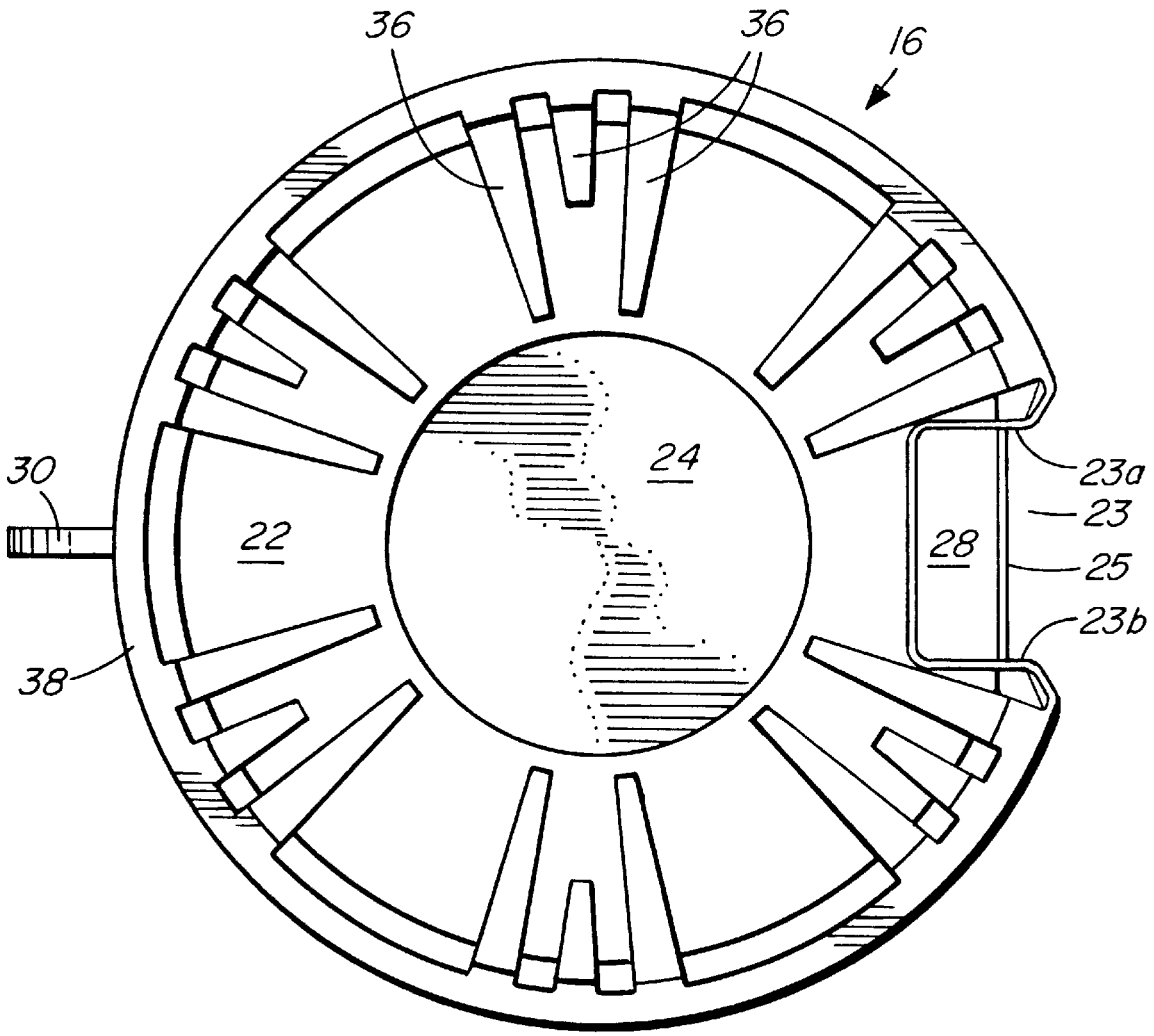
FIG. 4 shows an underneath plan view of the cap of FIGS. 1 through 3.

The cup-shaped body 16 of the cap 10 has an inner surface 32 which defines a hollow interior 34. As shown in FIG. 3, internal resiliently deformable grippers in the form of radially inwardly extending, upwardly inclined finger-shaped projections 36 extend from a radially inwardly extending annular flange 38 at the bottom of the skirt portion 18 into the hollow interior 34. As can be seen from FIG. 3, these finger-shaped projections 36 are of two different lengths.

For installing the protective pole cap 10 onto the top of the pole, the eye of the external projection 30 is firstly engaged with an installation tool, e.g. the above-mentioned "shotgun" installation rod, and the pole cap 10 is then lifted by means of this tool, for example by a person standing in a bucket truck, to a location above the pole top end portion 12 and is then lowered onto the pole top end portion 12. As the top end portion 12 enters the downwardly-open hollow interior 34 of the pole cap 10, the finger-shaped projections 36 are resiliently deflected by the top end portion 12 into resilient gripping engagement with the top end portion 12. The protective pole cap 10 is thus secured onto the top end portion 12, without the use of nails or other fasteners and without requiring the presence of an installing person in the close vicinity of the top end portion 12 of the pole. When the installation tool is disengaged from the eye, and withdrawn, the installation of the pole cap 10 is complete.

The frusto-conical top portion 22 of the cap 10 engages the top of the pole top end portion 12 so as to limit the downward movement of the pole cap 10 onto the pole and thus so as to leave an air gap, for the circulation of air, between the top of the pole and the cup-shaped body 16 of the pole cap 10 and, more particularly, the circular top 24 of the cup-shaped body 16.

The protective pole cap 10, which is molded in one piece from a suitable durable non-conductive plastic material, e.g. A.B.S. or polyethylene, then acts as a moisture barrier to protect the pole top end portion 12 from decay and weathering and, also, protects the top of the pole from animals. In connection with the latter, it has been found that in the case of utility poles equipped with sky pins, there is a risk that a bird, standing on the top of such a pole, may make contact with the live wire supported by the sky pin, with the consequence that the bird, being grounded through the pole, is electrocuted. The present cap 10 serves as an electrical insulator between any bird on the cap 10 and the pole and consequently prevents such electrocution.

The upwardly angled finger-shaped portions hold the cap 10 firmly in place and the cap 10 can thus be installed by a single person, even on in-service poles without disconnecting power, and after installation presents an aesthetically pleasing appearance.

The cap 10 is not restricted to use on wooden poles but may be installed on concrete and metal poles, in which case, as described above, it serves to prevent the electrocution of birds and does not require the insertion of any fastener into the pole.

If required, the cap 10 may be made in various sizes to fit various sizes of poles.

As will be understood by those skilled in the art, modifications may be made in the above-described protective pole cap 10 within the scope and spirit of the appended claims.

I claim:

1. A protective pole cap, comprising:

a downwardly-open, cup-shaped body for installation onto a top end portion of a pole;

said cup-shaped body comprising a lower skirt portion and a cylindrical wall having a diameter different from that of said skirt portion, said skirt portion including a radially extending portion connecting said skirt portion to said cylindrical wall;

said cup-shaped body having an inner surface and projections extending inwardly of said inner surface;

said projections being resilient to allow deflection of said projections into gripping engagement with the top end portion of the pole; and a tear-out panel at one side of said cup-shaped body, said panel being removable from said cup-shaped body to form a slot for accommodating a sky pin on the pole.

2. A protective pole cap as claimed in claim 1, wherein said cup-shaped body is formed with a recess, at said one side thereof, said tear-out panel is provided in said recess and said recess has opposite side walls extending inwardly of said cup-shaped body from said skirt portion and said cylindrical wall to said tear-out panel.

3. A protective pole cap as claimed in claim 1, wherein said cup-shaped body includes an upwardly convergent frusto-conical top portion and a recess at said one side of said body, said recess being in said skirt portion, said cylindrical wall and said frusto-conical top portion, said tear-out panel being in said recess at said skirt portion and said cylindrical wall and said cup-shaped body including a further tear-out panel in said recess in said frusto-conical top portion.

4. A protective pole cap as claimed in claim 1, wherein said cup-shaped body includes a single external projection, said external projection forming an eye for engagement by an installation tool.

5. A protective pole cap as claimed in claim 4, wherein said external projection is provided on said cylindrical wall at a side of said cup-shaped body opposite from said tear-out panel.

6. A protective pole cap as claimed in claim 1, wherein said projections extend from the bottom of said skirt portion and comprise radially inwardly extending, upwardly inclined finger-shaped projections.

* * * * *